US006328642B1

(12) United States Patent
Pant et al.

(10) Patent No.: US 6,328,642 B1
(45) **Date of Patent: *Dec. 11, 2001**

(54) INTEGRATED PAD AND BELT FOR CHEMICAL MECHANICAL POLISHING

(75) Inventors: Anil K. Pant, Santa Cruz; Rahul Jairath, San Jose; Kamal Mishra, San Jose; Saket Chadda, San Jose; Wilbur C. Krusell, Palo Alto, all of CA (US)

(73) Assignee: Lam Research Corporation, Fremont, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/800,373

(22) Filed: Feb. 14, 1997

(51) Int. Cl.[7] ..... B24B 21/04; B24B 7/22

(52) U.S. Cl. ..... 451/307; 451/41; 451/533

(58) Field of Search ..... 451/296, 307, 451/526, 531, 533, 536, 532, 41

(56) References Cited

U.S. PATENT DOCUMENTS

| | | | | |
|---|---|---|---|---|
| 4,018,574 | * | 4/1977 | Dyer | 451/531 |
| 4,576,612 | | 3/1986 | Shukla et al. . | |
| 4,589,233 | | 5/1986 | Parekh et al. . | |
| 4,728,552 | | 3/1988 | Jensen, Jr. . | |
| 4,753,838 | | 6/1988 | Kimura et al. . | |
| 4,841,680 | | 6/1989 | Hoffstein et al. . | |
| 4,841,684 | | 6/1989 | Hall, Jr. . | |
| 4,927,432 | | 5/1990 | Budinger et al. . | |
| 4,954,141 | | 9/1990 | Takiyama et al. . | |
| 4,962,562 | | 10/1990 | Englund et al. . | |
| 5,020,283 | | 6/1991 | Tuttle . | |
| 5,177,908 | | 1/1993 | Tuttle . | |
| 5,197,999 | | 3/1993 | Thomas . | |
| 5,212,910 | | 5/1993 | Breivogel et al. . | |
| 5,234,867 | | 8/1993 | Schultz et al. . | |
| 5,257,478 | | 11/1993 | Hyde et al. . | |
| 5,287,663 | | 2/1994 | Pierce et al. . | |
| 5,305,560 | | 4/1994 | Roelofs . | |
| 5,329,734 | | 7/1994 | Yu . | |
| 5,341,609 | | 8/1994 | Gorsuch et al. . | |
| 5,383,309 | * | 1/1995 | Sampietro | 451/533 |
| 5,433,651 | | 7/1995 | Lustig et al. . | |
| 5,441,598 | | 8/1995 | Yu et al. . | |
| 5,487,697 | | 1/1996 | Jensen . | |
| 5,489,233 | | 2/1996 | Cook et al. . | |
| 5,534,106 | | 7/1996 | Cote et al. . | |
| 5,558,568 | | 9/1996 | Talieh et al. . | |
| 5,573,619 | * | 11/1996 | Benedict et al. | 451/531 |
| 5,573,844 | | 11/1996 | Donavan et al. . | |
| 5,575,707 | | 11/1996 | Talieh et al. . | |
| 5,578,362 | | 11/1996 | Reinhardt et al. . | |

(List continued on next page.)

FOREIGN PATENT DOCUMENTS

| | | |
|---|---|---|
| 0 696 495 A | 2/1996 | (EP) . |
| 0 738 561 A1 | 10/1996 | (EP) . |
| 0 824 995 A1 | 2/1998 | (EP) . |
| 03 055170A | 3/1991 | (JP) . |
| 06047678 | 2/1994 | (JP) . |
| WO 93 12911 A | 7/1993 | (WO) . |

OTHER PUBLICATIONS

English Abstract of Japanese Patent Publication No. 03055170, published Mar. 8, 1991.

*Primary Examiner*—Robert A. Rose
(74) *Attorney, Agent, or Firm*—Brinks Hofer Gilson & Lione

(57) ABSTRACT

An integrated pad and belt for polishing a surface comprising a belt integrated with a polishing pad that forms a seamless polishing surface.

19 Claims, 5 Drawing Sheets

U.S. PATENT DOCUMENTS

| | | | | |
|---|---|---|---|---|
| 5,593,344 | | 1/1997 | Weldon et al. . | |
| 5,605,760 | | 2/1997 | Roberts . | |
| 5,650,039 | | 7/1997 | Talieh . | |
| 5,690,540 | | 11/1997 | Elliott et al. . | |
| 5,692,947 | * | 12/1997 | Talieh et al. | 451/41 |
| 5,722,877 | | 3/1998 | Meyer et al. . | |
| 5,762,536 | | 6/1998 | Pant et al. . | |
| 5,800,248 | | 9/1998 | Pant et al. . | |
| 5,871,390 | | 2/1999 | Pant et al. . | |
| 5,916,012 | | 6/1999 | Pant et al. . | |

* cited by examiner

INTEGRATED PAD AND BELT FOR CHEMICAL MECHANICAL POLISHING

BACKGROUND OF THE INVENTION

1. Field of the Invention

The present invention relates to the field of semiconductor wafer processing and, more particularly, to chemical-mechanical polishing of semiconductor wafers using a linear polisher.

2. Description of the Related Art

The manufacture of an integrated circuit device requires the formation of various layers (both conductive and non-conductive) above a base substrate to form the necessary components and interconnects. During the manufacturing process, removal of a certain layer or portions of a layer must be achieved in order to pattern and form various components and interconnects. Chemical mechanical polishing (CMP) is being extensively pursued to planarize a surface of a semiconductor wafer, such as a silicon wafer, at various stages of integrated circuit processing. Other examples of CMP include flattening optical surfaces, metrology samples, and various metal and semiconductor based substrates.

CMP is a technique in which a chemical slurry is used along with a polishing pad to polish away materials on a semiconductor wafer. The mechanical movement of the pad relative to the wafer in combination with the chemical reaction of the slurry disposed between the wafer and the pad, provide the abrasive force with chemical erosion to polish the exposed surface of the wafer (or a layer formed on the wafer), when subjected to a force pressing the wafer to the pad. In the most common method of performing CMP, a substrate is mounted on a polishing head which rotates against a polishing pad placed on a rotating table (see, for example, U.S. Pat. No. 5,329,732). The mechanical force for polishing is derived from the rotating table speed and the downward force on the head. The chemical slurry is constantly transferred under the polishing head. Rotation of the polishing head helps in the slurry delivery as well in averaging the polishing rates across the substrate surface.

One technique for obtaining a more uniform chemical mechanical polishing rate is to utilize a linear polisher. Instead of a rotating pad, a moving belt is used to linearly move the pad across the wafer surface. The wafer is still rotated for averaging out the local variations, but the global planarity is improved over CMP tools using rotating pads. One such example of a linear polisher is described in a pending application titled "Linear Polisher And Method For Semiconductor Wafer Planarization;" Ser. No. 08/287,658; filed Aug. 9, 1994. Unlike the hardened table top of a rotating polisher, linear polishers are capable of using flexible belts with separate pads disposed on the belts. This flexibility allows the belt to flex and change the pad pressure being exerted on the wafer.

A linear polishing tool generally has two separate consumables, a pad and a belt. The life span of a pad is short due to its use as the contact surface for polishing a semiconductor wafer and the need for conditioning the pad's surface during or between each polishing run. Although not replaced with the frequency of the pad, the belt also needs periodic replacement resulting from several causes including wear from the high operating speeds of the polisher, the heavy loads exerted on the belt during the polishing, and deformation or kinks due to accidents when replacing the polishing pads. The prior practice is to use separate polishing pads attached to stainless steel belts with an adhesive.

There are several disadvantages to using separate pads and belts with linear polishing tools. One disadvantage is that changing pads and or belts is both time consuming and costly. The mere act of replacing a pad and or a belt incurs a significant amount of time for labor. It typically takes about 15 to 20 minutes to install new pad strips on a belt, while the removal process of the old pad strips typically takes about 15 to 20 minutes. The cost associated with replacing belts and pads lies in the downtime associated with the their replacement. In the semiconductor industry, as with many industries, time is money. A linear polishing tool generally polishes one wafer every 2 to 3 minutes. Each additional or unnecessary minute spent replacing a pad and or a belt is lost revenue.

A pad (on a belt) generally consists of one or more strips of pad material with each strip being approximately equal to the belt width. One current example of a pad strip has a width of about 12 to 14 inches and a length of about 36 inches. The pad strips are put on the belt one at a time and must be carefully aligned to the belt and to each other. A very strong adhesive attaches the pad strips to the belt in such a way as to minimize and avoid the formation of air bubbles, which causes the pad strips to eventually separate from the belt.

When a pad wears out, it is necessary to replace all of the pad strips. The strips are removed from the belt by physically pulling or ripping them off of the belt. After removing the strips, it is necessary to remove the old adhesive from the belt. Removing the old adhesive usually requires using an organic solvent such as acetone or isopropyl alcohol. Great care is necessary during the removal process so as not to damage the belt since the belt by itself is typically only 0.02 inches thick.

Another disadvantage of the prior practice is the presence of one or more "seams" in the contact or polishing surface. A steel belt invariably has a noticeable welding seam that propagates through the pad to the polishing surface of the pad. The typical practice in manufacturing the belt is to take a rectangular piece of stainless steel and weld the ends together to form the stainless steel belt. The weld is then ground to smooth out the welded surface. Even with grinding the seam, there will still be some type of irregularity on the surface of the steel belt. After attaching the pad strips to the belt, this irregularity usually propagates through the pad so that the polishing surface of the pad will also have some irregularity or unevenness. Additional seams or irregularities on the polishing surface of the pad are produced when securing the pads to the belt. As previously noted, the typical practice is for the pads to be in rectangular strips before attachment to the belt. Another seam or some type of unevenness in the outer surface of the pad appears at the joinder of the two ends of the pad. Due to the small geometries required in semiconductor devices, any irregularities, unevenness, or seams on the pad's polishing surface will produce an uneven planarization on the surface of the semiconductor device.

The present invention describes an integrated pad and belt for polishing a surface such as glass or a semiconductor wafer. The integration of the pad with the belt reduces the down time of the linear polisher because there is only one piece to replace as opposed to the two pieces with the current practice. The manufacture of the integrated pad and belt allows a belt to be constructed without a noticeable welding seam, which reduces unevenness or irregularities on the polishing surface of the pad. Further, the integrating of the pad with the belt produces a seamless polishing surface, which further reduces the unevenness of the polishing surface of the pad. Still further, an integrated pad and belt eliminates trapped air bubbles between separate pads and belts resulting from replacing the pads. The present invention, therefore, reduces the number of defects by promoting a better polishing uniformity, and improves reliability by reducing the number of steps required to replace pads and belts, while at the same time, decreasing the down time of the linear polishing tool.

SUMMARY OF THE INVENTION

The present invention describes an integrated pad and belt for polishing a surface. The integrated pad and belt comprises a polishing pad integrated with a belt that forms a seamless polishing surface. The polishing pad component of the integrated pad and belt comprises a polymeric material. The belt component of the integrated pad and belt may comprise one or more of an aramid, cotton, metal, metal alloy, or polymeric material. An alternative embodiment of the present invention is a linear polishing tool comprising the above integrated pad and belt.

DETAILED DESCRIPTION OF THE INVENTION

This disclosure describes an integrated pad and belt for polishing a surface comprising a belt integrated with a polishing pad that forms a seamless polishing surface. The following description sets out numerous specific details such as specific structures, materials, polishing techniques, etc., to provide a thorough understanding of the present invention. However, one skilled in the art will appreciate that they may practice the present invention without these specific details. In other instances, this description does not describe well known techniques and structures in detail in order not to obscure the present invention. This disclosure describes the preferred embodiment of the present invention in reference to a linear polishing tool, however, the invention can be readily adapted to other polishing techniques, such as a rotating disk polishing tool. Although this disclosure describes the present invention in reference to performing CMP on a semiconductor wafer, the present invention is readily adaptable to polish other materials such as glass or substrates for the manufacture of flat panel displays.

Figure 1:
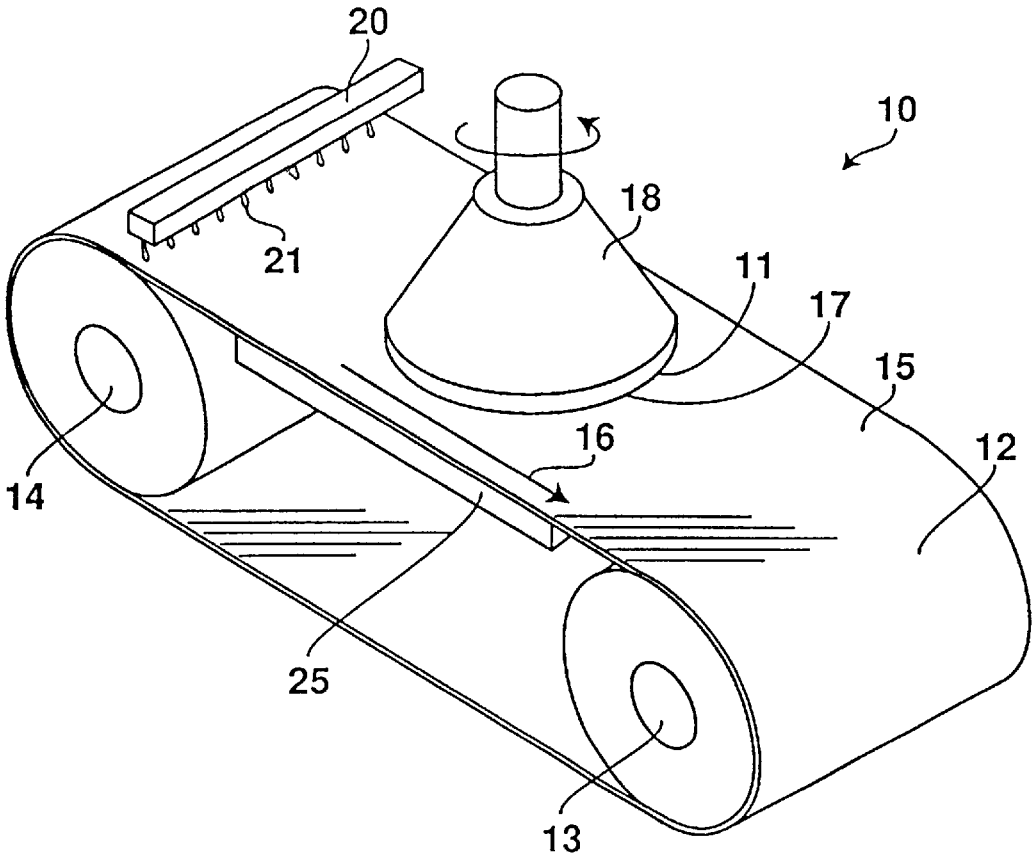
FIG. 1 PRIOR ART
FIG. 1 is a pictorial illustration of a linear polishing tool.
Figure 2:
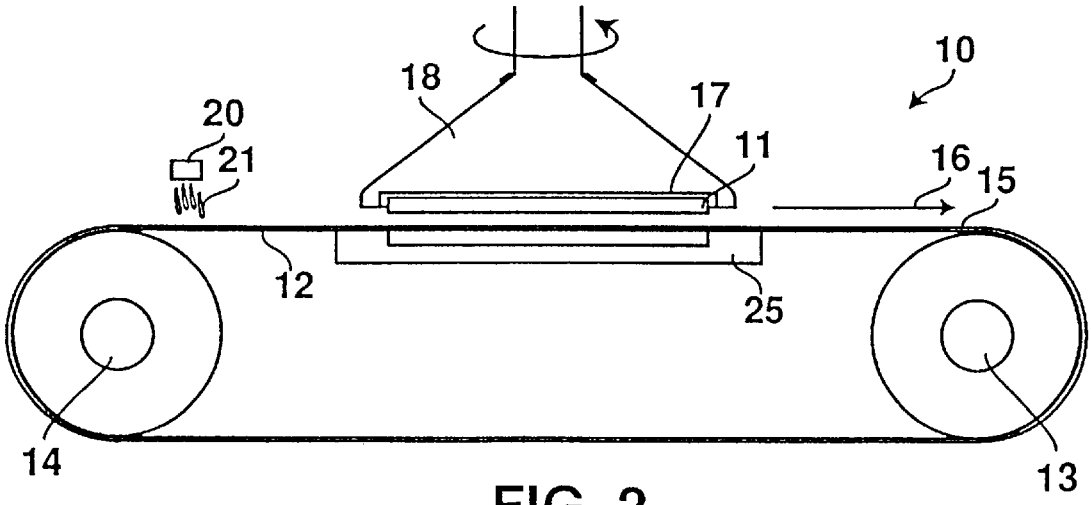
FIG. 2 PRIOR ART
FIG. 2 is a cross-sectional diagram of the linear polishing tool of FIG. 1.

FIGS. 1 and 2 show a linear polishing tool 10 in current practice. The linear polishing tool 10 polishes away materials on the surface of a semiconductor wafer 11. The material being removed can be the substrate material of the wafer itself or one of the layers formed on the substrate. Such formed layers include dielectric materials (such as silicon dioxide or silicon nitride), metals (such as aluminum, copper or tungsten), metal alloys or semiconductor materials (such as silicon or polysilicon). More specifically, a polishing technique generally known in the art as chemical-mechanical polishing (CMP) is employed to polish one or more of these layers fabricated on the wafer 11, in order to planarize the surface layer. Generally, the art of performing CMP to polish away layers on a wafer is known and prevalent practice has been to perform CMP by subjecting the surface of the wafer to a rotating platform (or platen) containing a pad (see for example, the Background section above). An example of such a device is illustrated in U.S. Pat. No. 5,329,732.

The linear polishing tool 10 utilizes a stainless steel belt 12 in the prior art, which moves linearly in respect to the surface of the wafer 11. The belt 12 is a continuous belt rotating about rollers (or spindles) 13 and 14. The rollers are driven by a driving means, such as a motor, so that the rotational motion of the rollers 13–14 causes the belt 12 to be driven in a linear motion with respect to the wafer 11, as shown by arrow 16. A polishing pad 15 in the prior art affixes onto belt 12 at its outer surface facing wafer 11 so that pad 15 moves linearly relative to wafer 11 as belt 12 is driven. The present invention describes an integrated pad and belt, which is an improvement over and a replacement for the separate pad and belt shown in the prior art.

The wafer 11 is made to reside within a wafer carrier 17, which is part of a housing 18. The wafer 11 is held in position by a mechanical retaining means (such as a retainer ring) and/or by vacuum. The wafer carrier 17 positions the wafer atop belt 12 so that the surface of the wafer comes in contact with pad 15. It is preferred to rotate the housing 18 in order to rotate the wafer 11. The rotation of the wafer 11 allows for averaging of the polishing contact of the wafer surface with 15. An example of a linear polishing tool is described in the previously mentioned pending patent application titled "Linear Polisher And Method For Semiconductor Wafer Planarization."

The linear polishing tool 10 additionally contains a slurry dispensing mechanism 20, which dispenses a slurry 21 onto pad 15. The slurry 21 is necessary for proper CMP of the wafer 11. A pad conditioner (not shown in the drawings) is typically used in order to recondition the pad during use. Techniques for reconditioning the pad during use are known in the art and generally require a constant scratching or grooving of the pad in order to remove the residue build-up caused by the used slurry and removed waste material. One of a variety of pad conditioning or pad cleaning devices can be readily adapted for use with linear polisher 10.

The linear polishing tool 10 also includes a platen 25 disposed on the underside of belt 12 and opposite from carrier 17, such that belt 12 resides between platen 25 and wafer 11. A primary purpose of platen 25 is to provide a supporting platform on the underside of belt 12 to ensure that the polishing surface of pad 15 makes sufficient contact with wafer 11 for uniform polishing. Typically, the carrier 17 is pressed downward against belt 12 and pad 15 with appropriate force, so that wafer 11 makes sufficient contact with the contact surface of pad 15 for performing CMP. Since the belt 12 is flexible and will depress when the wafer is pressed downward onto the pad 15, platen 25 provides a necessary counteracting force to this downward force.

Although platen 25 can be of a solid platform, a preference is to have platen 25 function as a type of fluid bearing for the practice of the present invention. One example of a fluid bearing is described in a pending U.S. patent application titled "Wafer Polishing Machine With Fluid Bearings;" Ser. No. 08/333,463; filed Nov. 2, 1994, which describes fluid bearings having pressurized fluid directed against the polishing pad.

Figure 3:
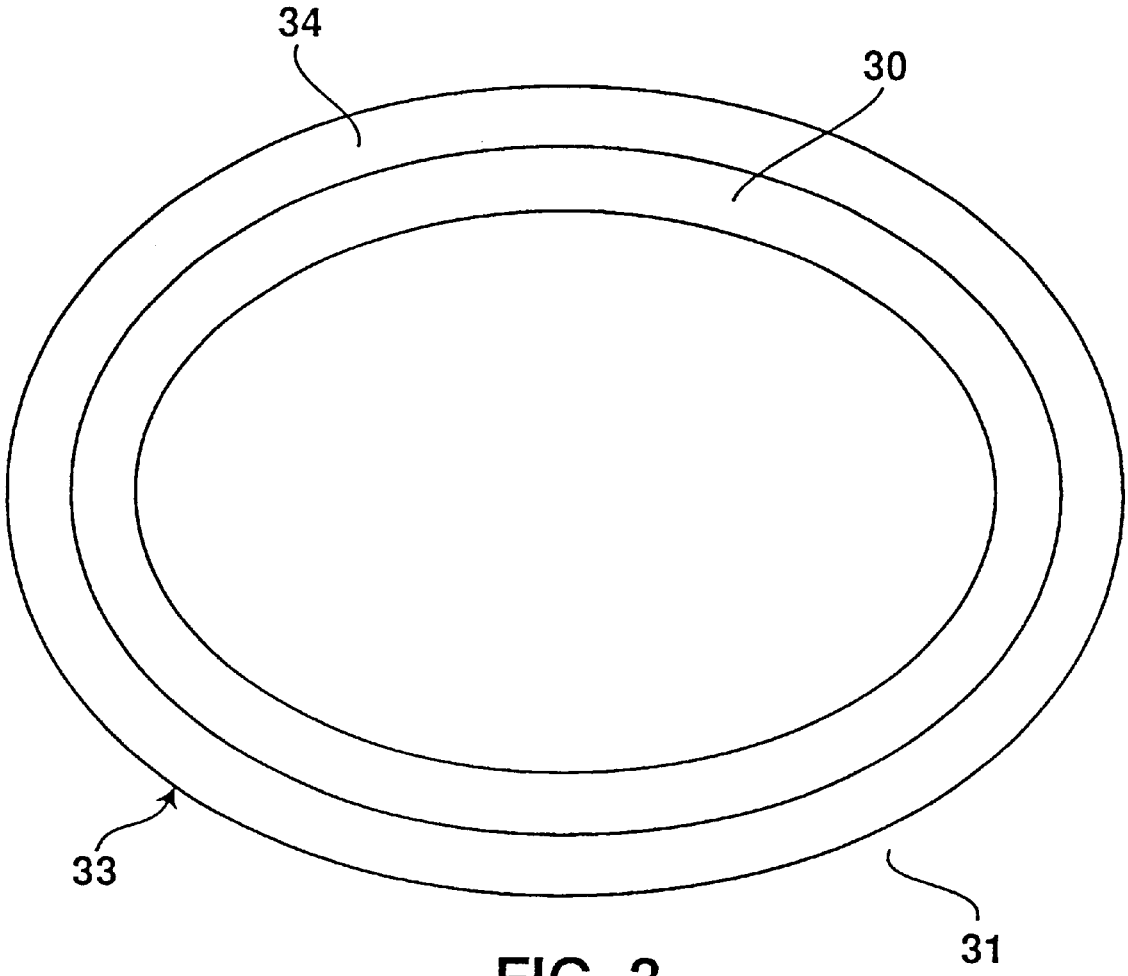
FIG. 3 is a cross sectional diagram of an integrated pad and belt for practicing the present invention.

The present invention describes an integrated pad and belt, which is an improvement over and a replacement for the separate pad and belt shown in the current practice of FIGS. 1 and 2. FIG. 3 is a cross sectional diagram of an integrated pad and belt 31 for practicing the present invention. The integrated pad and belt comprises a belt 30 integrated with a polishing pad 34 that forms a seamless polishing surface 33. The seamless polishing surface is a feature of the present invention, as previously stated, that eliminates pad to pad seams resulting from the joinder of pads and seams on the belt, due to it's manufacture, that propagate through the pad to appear on the polishing surface. Although the polishing surface 33 does not have seams, the polishing surface typically, although not required, has grooves, pits, or other similar types of indentions on the polishing surface to aid in the channeling of the polishing slurry and waste material. The preferred embodiment of the pad component of the integrated pad and belt uses grooves oriented in the direction of linear motion as a form of indention on it's polishing surface.

Figure 4A:
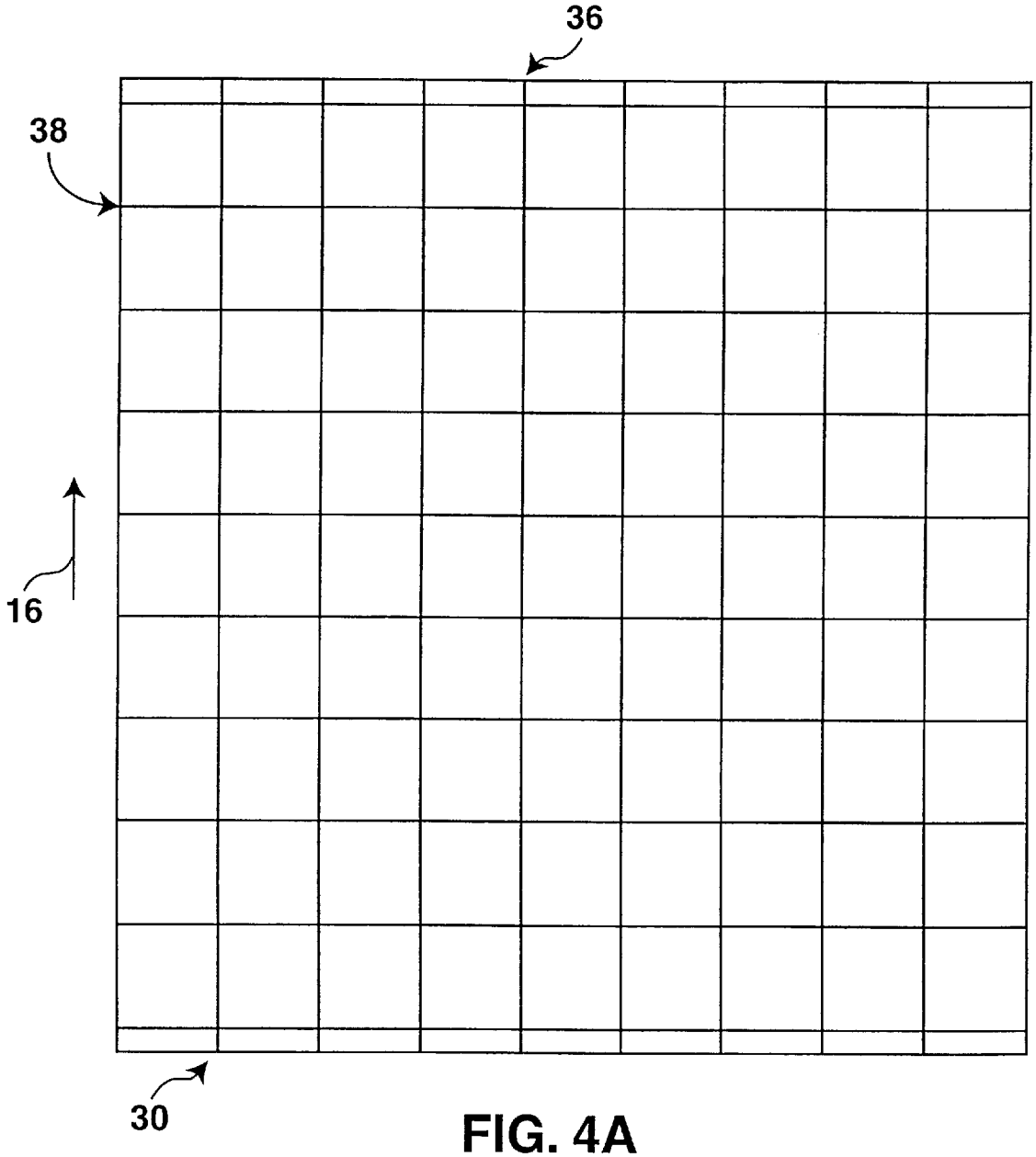
FIGS. 4A and 4B illustrate different embodiments for the weaving of fibers for a belt component of the integrated pad and belt of the present invention.
Figure 4B:
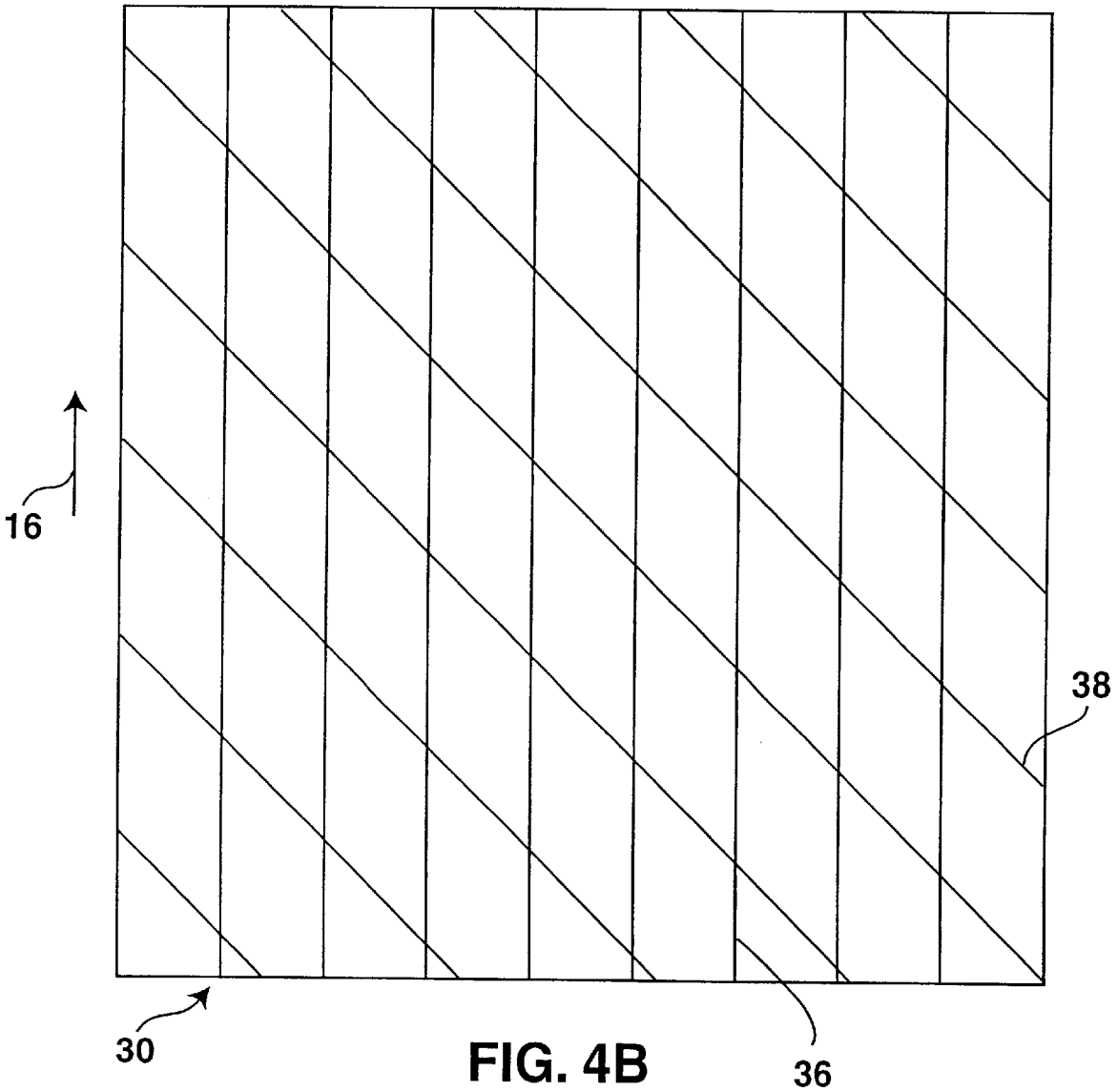

FIG. 4A and FIG. 4B illustrate a belt component 30 of the integrated pad and belt in FIG. 3. The belt component 30 of the preferred embodiment comprises weaved tensile material or fibers 36 and reinforcing material or fibers 38. The preferred embodiment of present invention uses aramid fibers for the tensile fibers and cotton fibers for the reinforcing fibers, where the aramid fibers further comprise KEVLAR™ aramid fibers. The weaving of the belt component 30 places the aramid fibers 36 in the direction of linear motion 16 of the linear polishing tool 10 of FIGS. 1 and 2 with the reinforcing cotton fibers 38 offset angularly from the aramid fibers. The belt component provides the integrated pad and belt with a high tensile strength necessary to withstand the downward force exerted by the wafer carrier 17 of FIG. 2, a pressure that in current practice comprises a force of 3000 pounds of pressure. An additional benefit of the aramid fibers in the belt component is they are not reactive to the chemicals used in CMP. Although the preferred embodiment of the present invention uses aramid and cotton fibers for the belt component of the integrated pad and belt, other types of materials are also suitable for use in the belt component that includes metals such as stainless steel, metal alloys, or a polymeric material. Additionally, one skilled in the art will appreciate that reinforcing fibers provide reinforcement to the tensile fibers when offset at some angle. The degree of reinforcement is dependent upon the offset angle and the nature of the weave, e.g., one can have reinforcement material at different offsets from the tensile material. FIG. 4A illustrates the reinforcement material at an orthogonal angle to the tensile material, and FIG. 4B illustrates the reinforcement material at an offset angle to the tensile material.

The preferred thickness of the belt component comprises a thickness between 0.010 inches and 0.200 inches, with the preferred embodiment having a thickness of approximately 0.025 inches. Although this disclosure describes a range of thicknesses, one skilled in the art will appreciate that other thicknesses of the belt component are possible.

Even though the belt component is originally manufactured in a rectangular piece, the fibrous nature of the belt component allows the two ends of the rectangular piece to be weaved together to form an endless belt. The weaving of the two ends produces a belt component with virtually no noticeable seam, which is in stark contrast to the welding and grinding of current practice with stainless steel belts.

Figure 5:
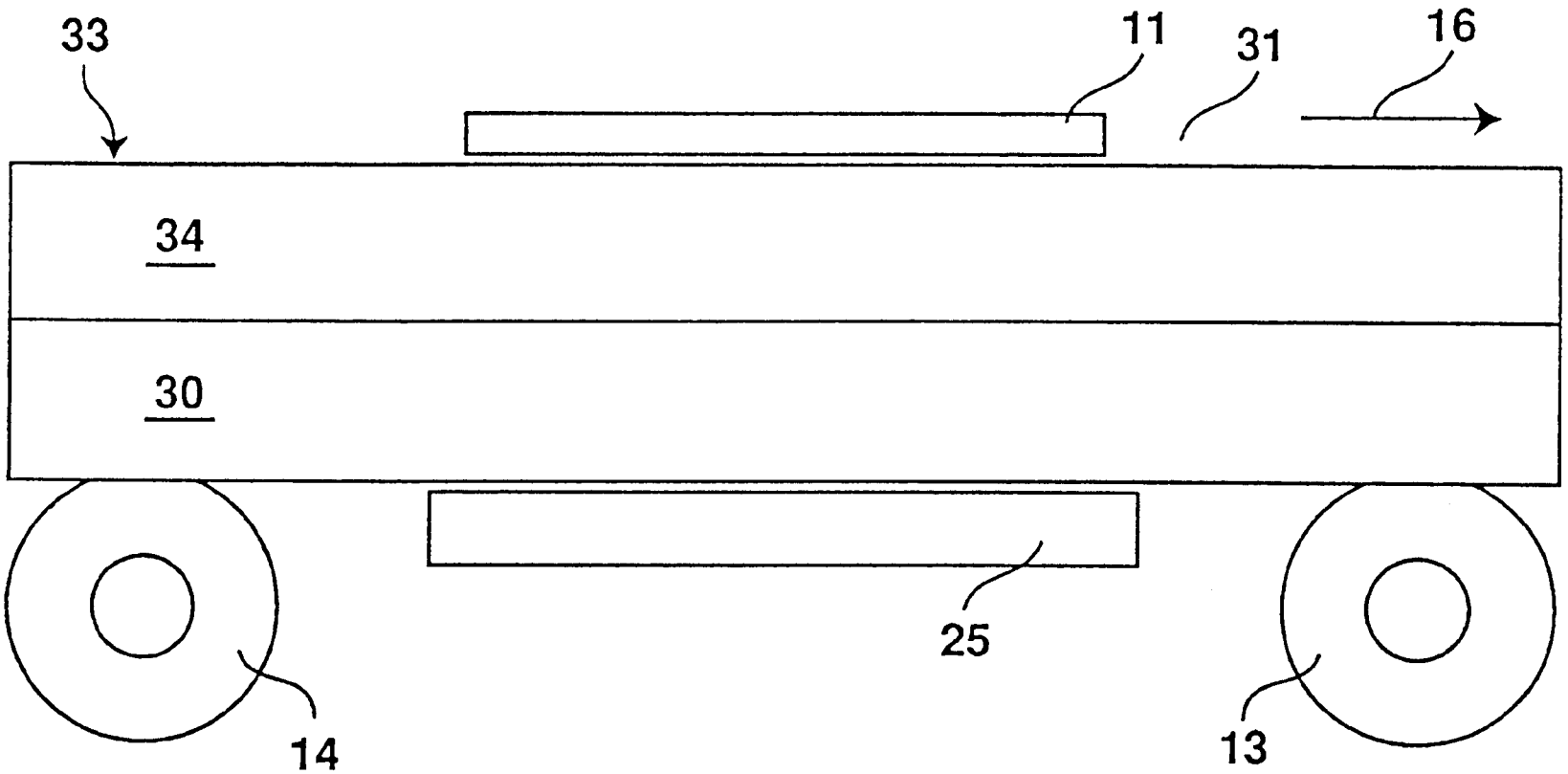
FIG. 5 is a pictorial illustration of an integrated pad and belt with a linear polishing tool for practicing the present invention.

FIG. 5 is a pictorial illustration of an integrated pad and belt 31 with the linear polishing tool of FIGS. 1 and 2. FIG. 5 illustrates the integrated pad and belt replacing the separate pad and belt shown in the current practice. The pad component 34 of the integrated pad and belt comprises a polymeric material and provides a seamless polishing surface 33 for wafer 11. Although the preferred embodiment of the present invention uses a polymeric material for the pad component of the integrated pad and belt, other types of polymeric materials such as polyester or polyurethane are also suitable for use in the pad component.

The thickness of the pad component of the integrated pad and belt helps in achieving an even planarization of the wafer with the linear polishing tool. Additionally, the thickness of the pad component in combination with the material used in the pad component determines the durability or life time of the pad. The preferred thickness of the pad component comprises a thickness between 0.010 inches and 0.250 inches, with the preferred embodiment having a thickness of approximately 0.100 inches. Although this disclosure describes a range of thicknesses, one skilled in the art will appreciate that other thicknesses of the pad component are possible.

An integration process integrates the pad component 34 with the belt component 30 to form the integrated pad and belt. The preferred integration process, a molding process, forms and integrates the pad component in a single step. Additionally, the integration process helps in the formation of a seamless polishing surface 33 on the integrated pad and belt 31 by firmly integrating the two components together so that the integrated unit is able to withstand the high linear speeds necessary for CMP with a linear polishing tool. Further, the integration process effectively fills in any irregularities or unevenness that may occur in the belt component so that any defects do not propagate through to the seamless polishing surface. An alternative embodiment of the present invention integrates another pad component on the underside of the belt component 30. Although the preferred embodiment of the present invention uses a molding process for the integration process, other types integration processes are also suitable for integrating the pad component with the belt component including extrusion processes or adhesive molding processes.

FIG. 5 additionally describes another embodiment of the present invention that comprises the linear polisher 10 of FIGS. 1 and 2 and the integrated pad and belt 31.

The present invention describes an integrated pad and belt for polishing a surface. The integrated pad and belt comprises a polishing pad integrated with a belt that forms a seamless polishing surface. An alternative embodiment of the present invention is a linear polishing tool comprising the above integrated pad and belt. An advantage of integrating a polishing pad with a belt is that the integrated unit reduces the down time of the linear polishing tool because there is only one piece to replace as opposed to the two pieces with the current practice. Another advantage of an integrated pad and belt is that it eliminates trapped air bubbles between separate pads and belts resulting from replacing the pads. Yet another advantage is that the integration of the polishing pad with the belt allows one to manufacture an integrated unit with a seamless polishing surface. A seamless polishing surface promotes an even planarization of the wafer. Together, these advantages reduce the number of defects in the wafer by promoting a better polishing uniformity and more even planarization, and improves reliability by reducing the number of steps and the time required to replace separate pads and belts, and at the same time decreasing the down time of the linear polishing tool.

We claim:

1. An integrated pad and belt for polishing a surface of a semiconductor substrate, comprising:

a belt for use on a polishing tool in which said belt is intended for movement across the surface of the semiconductor substrate, said belt comprising a tensile material of sufficient strength to support a force exerted by the semiconductor substrate;

a polishing pad molded with said belt to form a unitary integrated piece when fabricated onto said belt so that irregularities or unevenness between said polishing pad and said belt are removed, said polishing pad comprising a polishing material for engaging the semiconductor substrate to perform chemical mechanical polishing on the surface of the semiconductor substrate when subjected to a slurry.

2. The integrated pad and belt of claim 1 wherein said polishing pad comprises a seamless polishing surface.

3. The integrated pad and belt of claim 1 wherein said polishing pad comprises a polymeric material.

4. The integrated pad and belt of claim 1 wherein said tensile material comprises an aramid fiber weaved in a direction of intended movement and said belt further comprises a reinforcing material of cotton fiber weaved at an angle from the direction of the intended movement.

5. The integrated pad and belt of claim 4 wherein said belt thickness is approximately in the range of 0.010–0.20 inch.

6. An integrated pad and belt for polishing a surface of a semiconductor wafer by performing chemical mechanical polishing, comprising:

a belt for use on a polishing tool in which said belt is intended for linear movement across the surface of the semiconductor wafer, said belt comprising a tensile material of sufficient strength to support a force exerted by the semiconductor wafer;

a polishing pad molded with said belt to form a unitary integrated piece when fabricated onto said belt, said polishing pad comprising a polishing material for engaging the semiconductor wafer to perform chemical mechanical polishing on the surface of the semiconductor wafer when subjected to a slurry, said polishing pad having a surface comprising indentations oriented in the direction of the linear movement for channeling the slurry.

7. The integrated pad and belt of claim 6 wherein said polishing pad comprises a seamless polishing surface.

8. The integrated pad and belt of claim 6 wherein said polishing pad comprises a polymeric material.

9. The integrated pad and belt of claim 6 wherein said tensile material comprises an aramid fiber weaved in a direction of intended movement and said belt further comprises a reinforcing material of cotton fiber weaved at an angle from the direction of the intended movement.

10. The integrated pad and belt of claim 9 wherein said belt thickness is approximately in the range of 0.010–0.20 inch.

11. A chemical mechanical polishing tool using an integrated pad and belt for polishing a semiconductor wafer, comprising:

an integrated pad and belt for moving continuously in a linear direction relative to the semiconductor wafer when the semiconductor wafer is engaged onto said integrated pad and belt for performing CMP when subjected to a slurry; said integrated pad and belt having an upper surface that does not require a fixed abrasive; said integrated Dad and belt comprising:

a tensile material having sufficient strength to support a force exerted by the semiconductor wafer when driven linearly to perform chemical mechanical polishing on the semiconductor wafer; and a polishing pad material formed as a unitary integrated piece when fabricated on said tensile material;

wherein said tensile material comprises an aramid fiber weaved in a direction of intended movement and further supported by a reinforcing material of cotton fiber weaved at an angle from the direction of the intended movement.

12. The integrated pad and belt of claim 11 wherein said pad thickness is approximately in the range of 0.010–0.25 inch.

13. An integrated pad and belt for polishing a surface of a semiconductor substrate, comprising:

a belt for use on a polishing tool in which said belt is intended for movement across the surface of the semiconductor substrate, said belt comprising:

a tensile material weaved in a direction of intended movement; and a reinforcing material weaved at an angle from the direction of the intended movement; and a polishing pad integrated with said belt to form a unitary integrated piece when fabricated, said polishing pad comprising a polishing material for engaging the semiconductor substrate to perform chemical mechanical polishing on the surface of the semiconductor substrate when subjected to a slurry.

14. The integrated pad and belt of claim 13 wherein said polishing pad comprises a seamless polishing surface.

15. The integrated pad and belt of claim 13 wherein said polishing pad comprises a polymeric material.

16. The integrated pad and belt of claim 13 wherein said tensile material comprises an aramid fiber.

17. The integrated pad and belt of claim 13 wherein said reinforcing material comprises a cotton fiber.

18. The integrated pad and belt of claim 13 wherein said belt thickness is approximately in the range of 0.010–0.20 inch.

19. An integrated pad and belt for polishing a surface of a semiconductor substrate, comprising:

a belt for use on a polishing tool in which said belt is intended for movement across the surface of the semiconductor substrate, said belt comprising:

a tensile material weaved in a direction of intended movement; and a reinforcing material weaved at an angle from the direction of the intended movement; and a polishing pad integrated with said belt to form a unitary integrated piece when fabricated, said polishing pad comprising a polishing material for engaging the semiconductor substrate to perform chemical mechanical polishing on the surface of the semiconductor substrate.

* * * * *

UNITED STATES PATENT AND TRADEMARK OFFICE

CERTIFICATE OF CORRECTION

PATENT NO. : 6,328,642 B1
DATED : December 11, 2001
INVENTOR(S) : Anil K. Pant et al.

It is certified that error appears in the above-identified patent and that said Letters Patent is hereby corrected as shown below:

Column 8,
Line 5, delete "Dad" and substitute -- pad -- in its place.

Signed and Sealed this

Twentieth Day of August, 2002

*Attest:*

*Attesting Officer*

JAMES E. ROGAN
*Director of the United States Patent and Trademark Office*